US006543057B2

(12) United States Patent
Béland et al.

(10) Patent No.: US 6,543,057 B2
(45) Date of Patent: Apr. 8, 2003

(54) PROTECTIVE SPORTING GLOVE

(75) Inventors: Jean-Francois Béland, St-Laurent (CA); Jean-Francois Fullum, Portland, OR (US)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/941,978

(22) Filed: Aug. 29, 2001

(65) Prior Publication Data

US 2002/0069445 A1 Jun. 13, 2002

(30) Foreign Application Priority Data

Dec. 13, 2000 (CA) ..... 2328337

(51) Int. Cl.[7] ..... A41D 19/00
(52) U.S. Cl. ..... 2/161.1; 2/16
(58) Field of Search ..... 2/16, 20, 158, 2/159, 161.1, 161.6, 163; 128/878, 879, 880; 602/21, 22

(56) References Cited

U.S. PATENT DOCUMENTS

| | | | | |
|---|---|---|---|---|
| 3,725,957 A | | 4/1973 | Shotmeyer | |
| 4,027,339 A | | 6/1977 | Brucker | |
| 4,137,572 A | | 2/1979 | Jansson et al. | |
| 4,190,902 A | | 3/1980 | Rhee | |
| 4,497,073 A | | 2/1985 | Deutsch | |
| 4,677,698 A | | 7/1987 | Angas | |
| 4,787,376 A | * | 11/1988 | Eisenberg | 128/880 |
| 4,815,147 A | | 3/1989 | Gazzano et al. | |
| 4,930,162 A | | 6/1990 | Côté | |
| 4,967,418 A | | 11/1990 | Marcotte | |
| 5,018,221 A | * | 5/1991 | Romandetto | 128/878 |
| 5,237,703 A | | 8/1993 | Brine et al. | |
| 5,488,739 A | | 2/1996 | Cardinal | |
| 5,511,243 A | | 4/1996 | Hall et al. | |
| 5,745,916 A | | 5/1998 | Linner | |
| 5,787,506 A | | 8/1998 | Wilder et al. | |
| 5,946,720 A | | 9/1999 | Sauriol | |
| 5,983,396 A | | 11/1999 | Morrow et al. | |
| 5,996,117 A | * | 12/1999 | Goldsmith et al. | 2/161.1 |
| 6,065,150 A | * | 5/2000 | Huang | 2/161.1 |

FOREIGN PATENT DOCUMENTS

| | | |
|---|---|---|
| CA | 2035717 | 8/1992 |
| CA | 2288593 | 5/2000 |

* cited by examiner

*Primary Examiner*—Gary L. Welch
(74) *Attorney, Agent, or Firm*—RatnerPrestia

(57) ABSTRACT

A protective sporting glove featuring a hand receiving portion and a cuff portion cooperating to protect the entire hand of the wearer, the wrist, the thumb and the four fingers; the hand receiving portion includes finger sheath means for receiving and enclosing the four fingers of a hand placed in the glove; each of the finger sheath means comprises an elongated protective padding element extending along the dorsal side of the finger sheath means. The hand receiving portion further including a thumb receiving portion enclosing the thumb from an area proximate the base of the thumb to the tip of the thumb and comprising a rigid thumb shell covering the dorsal side of the thumb receiving portion. The rigid thumb shell having two related shell portions, a first shell portion extending from the base of the wearer's thumb to the middle portion of the wearer's thumb and a second shell portion extending from the middle of the wearer's thumb to the tip of the wearer's thumb; wherein the second shell portion is adapted to flex relative to said first shell portion.

25 Claims, 6 Drawing Sheets

PROTECTIVE SPORTING GLOVE

FIELD OF THE INVENTION

The present invention relates to the field of protective equipment for use in sporting activities. More particularly the invention relates to protective sporting gloves such as those used for playing hockey, lacrosse, and other similar sporting activities.

BACKGROUND OF THE INVENTION

Various protective sporting gloves have been developed over the years for hockey, lacrosse, and other similar sporting activities requiring strong protection against forceful impact with hard objects such as hockey puck or lacrosse ball or from hockey sticks or skates, or from lacrosse sticks of other players. These gloves must offer substantial protection to the wearer's hand and wrist while offering the best possible degree of flexibility for the wearer's fingers for holding and handling a stick and executing rapid and precise maneuvers of the stick during play. Protective sporting gloves for such sports are therefore heavily padded to provide the required protection and this padding often impairs the freedom of movement of the hand.

In general, the exterior surface of a protective glove is heavily padded while the interior surface in contact with the stick is unpadded and made of supple material such as leather or synthetic material. Finger sheaths are especially well padded on their exterior surface while the thumb portion of the glove is made of a rigid exterior shell portion which covers a supple thumb sheath extending under the thumb shell portion, itself covered with a layer of fabric material. The front portion of the thumb sheath is separate from the thumb shell and is loosely connected to the front end of the thumb shell. The separation of the two thumb elements allows a limited degree of mobility to the thumb but also restricts its movement. The rigid thumb shell portion is necessary, as the thumb is particularly vulnerable to impact and blows especially for the hand holding the middle portion of a hockey stick. The thumb portion in this case faces forward of the player and rests upon the upper edge of the stick which again is more exposed. Therefore, the thumb must have increased protection on the upper surface as well as on both sides, which is provided by a rigid shell portion. Other fingers have their top surface padded while their sides are unprotected, except for the index finger and the auricular finger where their exterior sides are also partially padded for protection. The rigid shell structure of the thumb portion of a typical protective glove provides adequate protection but restricts the freedom of movement of the thumb.

Thus, there is a need for a protective sporting glove providing increased freedom of movement of the thumb for better stick handling while affording good protection of the thumb against impact.

OBJECTS AND STATEMENT OF THE INVENTION

It is thus an object of the invention to provide a protective sporting glove adapted to provide increased freedom of movement of the thumb for better stick handling while affording good protection of the thumb against impact.

As embodied and broadly described herein, the invention provides a protective sporting glove comprising:

a hand receiving portion and a cuff portion cooperating to protect the entire hand of the wearer, the wrist, the thumb and the four fingers; the hand receiving portion having a palm side and a dorsal side; the palm side being made of soft flexible material and the dorsal side comprising a padded surface. The hand receiving portion includes finger sheath means for receiving and enclosing the four fingers of a hand placed in the glove; the finger sheath means extending from an area proximate the base of the four fingers to the end of the fingers; each of the finger sheath means comprising an elongated protective padding element extending along the dorsal side of the finger sheath means.

The hand receiving portion further includes a thumb receiving portion for receiving and enclosing the wearer's thumb; the thumb receiving portion encloses the thumb from an area proximate the base of the thumb to the tip of the thumb; the thumb receiving portion comprises a rigid thumb shell covering the dorsal side of the thumb receiving portion; the rigid thumb shell having a first shell portion and a second shell portion hinged together in the vicinity of the articulation between the distal phalanx and the middle phalanx of the thumb thereby allowing flexion of the second shell portion with relation to the first shell portion.

Advantageously, the first and second shell portion of the rigid thumb shell comprise an outer lip extending along the outer edge of the first and second portion, the outer lip being sewn to the soft flexible material making up the palm side of the thumb sheath. The first and second shell portion are hinged together at their respective outer edges by means of the outer lip being sewn to the palm side of the thumb sheath.

Preferably, the first and second shell portion of the rigid thumb shell comprise a stopping means adapted to prevent flexion of the second shell portion beyond a predetermined point. In a specific example of implementation, the stopping means comprise a first projection adapted for insertion within a slot and capable of movement therein. The first projection is securely retained within the slot via a second projection which extends laterally therefrom. More specifically, the first and second projections are associated with either one of the first or second shell portions while the slot is associated with the other remaining shell portion.

In a preferred embodiment, the protective glove further comprises an adjustable cuff portion connected to the hand receiving portion and extending over the wrist area. The cuff portion has a plurality of padded elements positioned around at least a portion of the circumference of the cuff portion and defining a peripheral forearm protector, each padded element partially overlapping an adjacent padded element. Preferably, a strap is used to adjust the diameter of the cuff portion. In a further preferred embodiment of protective glove, one of the padded elements is adjustable in length.

As embodied and broadly described herein, the invention provides a hockey glove comprising:

a hand receiving portion and a cuff portion cooperating to protect the entire hand of the wearer, the wrist, the thumb and the four fingers; the hand receiving portion having a palm side and a dorsal side; the palm side being made of soft flexible material and the dorsal side comprising a padded surface. The hand receiving portion includes finger sheath means for receiving and enclosing the four fingers of a hand placed in the hockey glove; the finger sheath means extending from an area proximate the base of the four fingers to the end of the fingers. Each of the finger sheath means comprises an elongated protective padding element extending along the dorsal side of the finger sheath means. The hand receiving portion further includes a thumb receiving portion for receiving and enclosing the wearer's thumb; the thumb receiving portion enclosing the thumb from an area proximate the base of the thumb to the tip of the thumb; the thumb receiving portion comprises a rigid thumb shell covering the dorsal side of the thumb receiving portion; the rigid thumb shell having two related shell portions, a first shell portion extending from the base of the wearer's thumb to the middle portion of the wearer's thumb and a second shell portion extending from the middle of the wearer's thumb to the tip of the wearer's thumb wherein the second shell portion is adapted to flex relative to the first shell portion.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
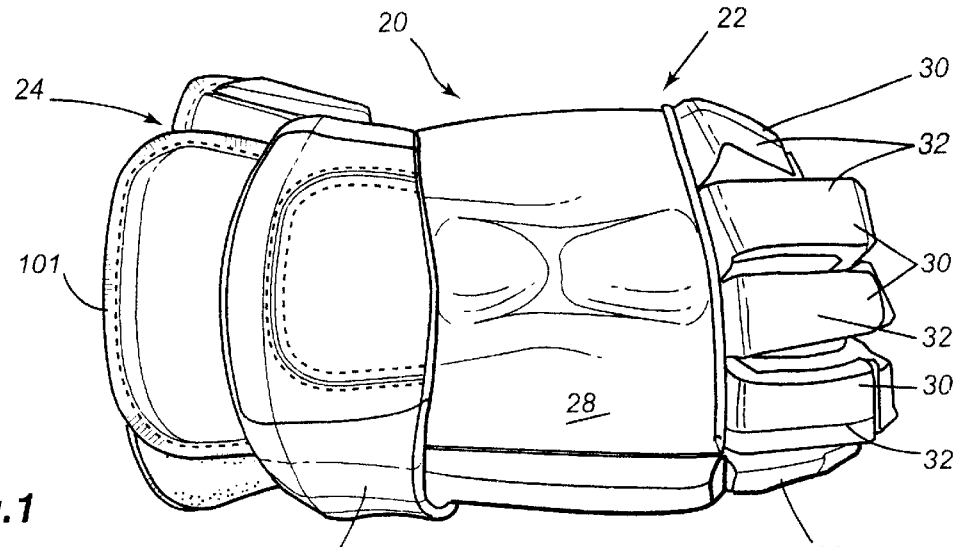
FIG. 1 is a top plan view of a protective sporting glove according to one embodiment of the invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF PREFERRED EMBODIMENTS

Figure 2:
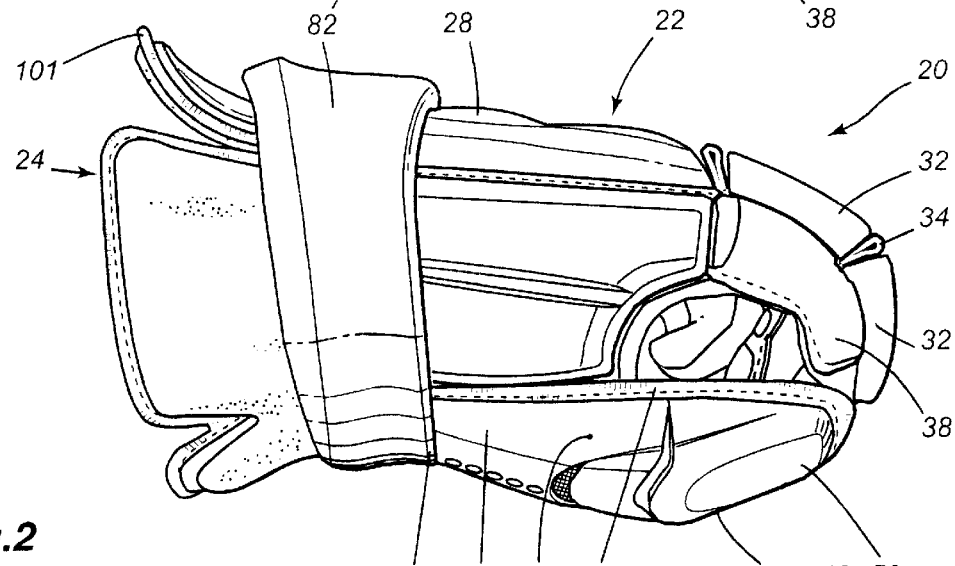
FIG. 2 is a right side elevational view of the protective sporting glove of FIG. 1.
Figure 3:
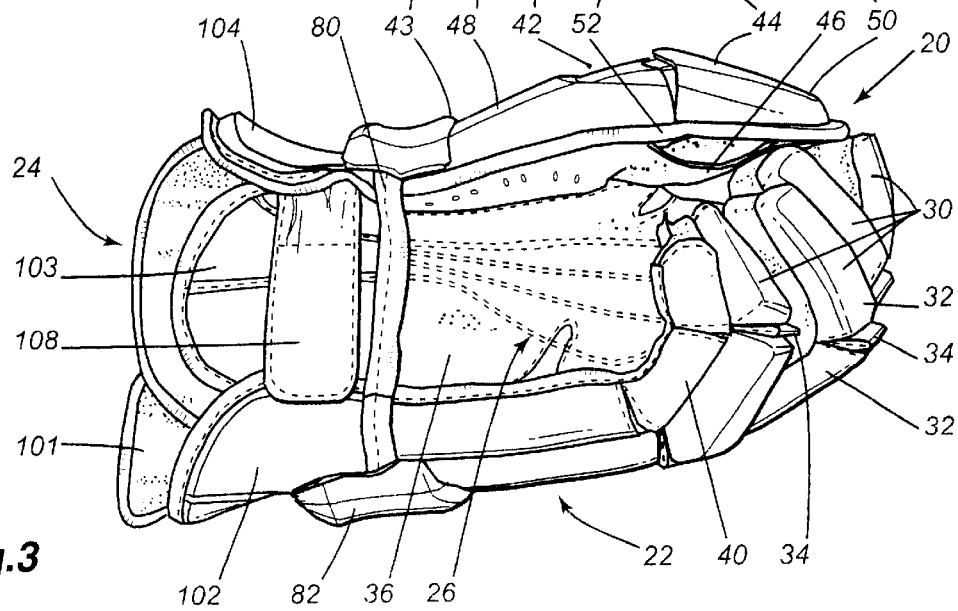
FIG. 3 is a left side elevational view of the protective sporting glove of FIGS. 1 and 2.

Referring to FIGS. 1 to 3, there is shown a protective sporting glove 20 specifically designed for playing hockey, lacrosse and other similar sporting activities requiring strong protection against impacts. Sporting glove 20 comprises a hand receiving portion 22 and a cuff portion 24. The hand receiving portion 22 includes a palm side 26 made of soft flexible material such as leather or synthetic textile material and a dorsal side 28 which is heavily padded. Cuff portion 24 is sewn to hand receiving portion 22 around its circumference along a line defined by sewing line 80 (FIG. 3) which is then covered around a substantial portion of the circumference of protective glove 20 with a heavy padding bracelet 82.

Hand receiving portion 22 includes a plurality of finger sheaths 30 for receiving and enclosing each of the four fingers of the player's hand. Finger sheaths 30 are adapted to enclose at least one finger and may enclose more than one finger in other configurations of sporting glove 20 (not shown). Each finger sheath 30 extends from an area proximate the base of the player's fingers to the end of the fingers. Each finger sheath 30 comprises a pair of elongated protective padding elements 32 extending along the dorsal side 28 of each finger sheath 30. A spacer 34 made of flexible material fills the gap between the padding elements 32 of the same finger sheath 30 and protects the player's knuckles when the finger sheath 30 is fully bent inwardly. Padding elements 32 are made of materials conventionally found in the prior art. Such materials include polyethylene inserts and may include various composite materials designed to absorb the energy of an impact. The palm side 26 of each finger sheath 30 may be made of the same flexible material as the palm portion 36 of hand receiving portion 22 and is a continuation thereof. The sides of each finger sheath 30 linking the palm side 26 to padding element 32 are however made of an elastic synthetic material giving each finger sheath 30 added flexibility while simultaneously facilitating the reduction of the moisture levels within each finger sheath 30. The outer side of the index finger sheath 30 comprises a further padding element 38 (FIGS. 1 and 2) to protect the exposed side of the index finger. Similarly, the outer side of the auricular finger sheath 30 also comprises a further padding element 40 (FIG. 3) adapted to protect the exposed side of the auricular finger. With this construction the entire external surface of the player's hand and fingers is properly protected against blows and impacts.

Hand receiving portion 22 further comprises a thumb receiving portion 42 for receiving and enclosing the player's thumb from an area proximate the base 43 of the player's thumb to the tip of the thumb. Thumb receiving portion 42 comprises a rigid thumb shell 44 covering the dorsal side of the player's thumb and a flexible leather-like material inner thumb sheath 46 covering at least the palm side or inner side of the player's thumb. The rigid thumb shell 44 comprises a first shell portion 48 extending from the base of hand receiving portion 22 to approximately the knuckle of the thumb; and a second shell portion 50 extending from the knuckle of the thumb to the end of the thumb. Preferably, shell portions 48 and 50 each comprise an outer lip 54 (as shown in subsequent figures) which is provided to secure shell portions 48 and 50 to inner thumb sheath 46 and to palm portion 36. A textile braid 52 encloses the outer lip 54 of each shell portion 48 and 50 and the edges of inner sheath 46 and palm portion 36. Braid 52 is sewn to each shell portion 48 and 50 and to inner sheath 46 and palm portion 36 such that first and second shell portions 48 and 50 are hinged together at their base by braid 52. Braid 52 is made of a resistant textile material, which flexibly holds thumb receiving portion 42 together.

Thumb receiving portion 42 is adapted to bend in the general area of the knuckle of the thumb thereby increasing the freedom of movement of the thumb and providing for a less restrictive glove 20. As illustrated in FIGS. 2 and 3, the two shell portions 48 and 50 are coupled at the thumb's knuckle area and partially overlap each other such that a bending motion is possible without, however, compromising the level of protection offered.

Figure 4:
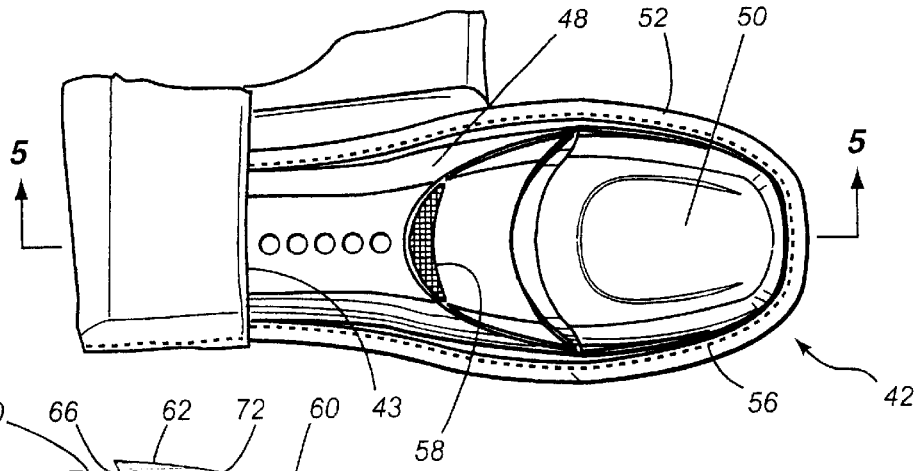
FIG. 4 is an enlarged plan view of the thumb receiving portion of the protective sporting glove of FIGS. 1 to 3 shown in the extended position.
Figure 5A:
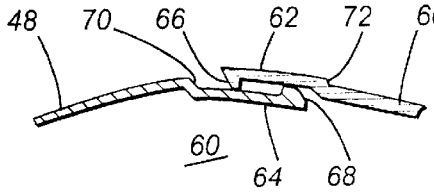
FIG. 5*a* is a an enlarged view of the thumb receiving portion shown in FIG. 5.
Figure 5:
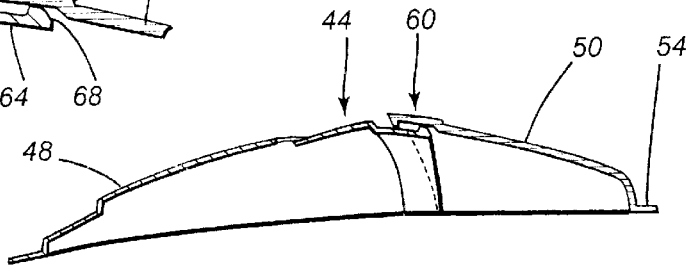
FIG. 5 is a cross sectional view of the thumb receiving portion taken at lines 5—5 of FIG. 4.
Figure 6:
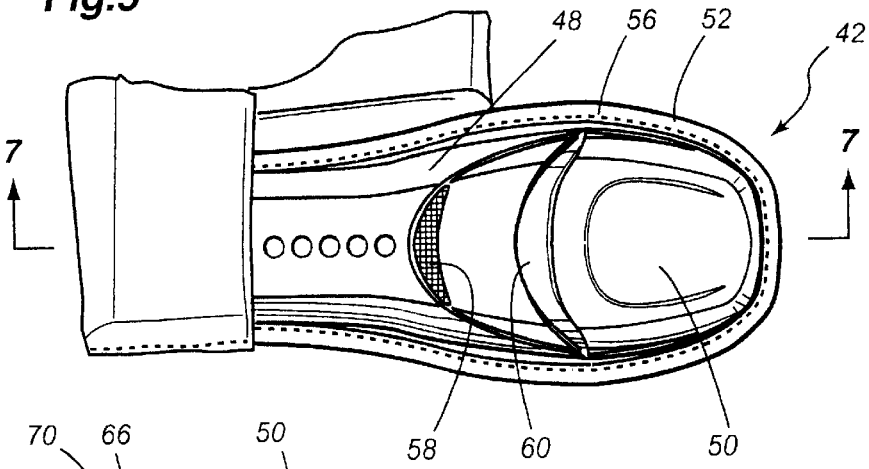
FIG. 6 is an enlarged plan view of the thumb receiving portion of the protective sporting glove of FIGS. 1 to 3 shown in a bent position.
Figure 7A:
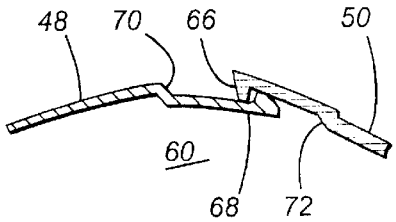
FIG. 7*a* is an enlarged view of the thumb receiving portion shown in FIG. 7.
Figure 7:
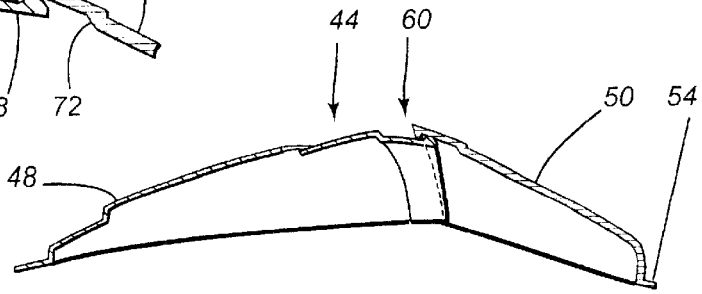
FIG. 7 is a cross sectional view of the thumb receiving portion taken at lines 7—7 of FIG. 6.

Referring now to FIGS. 4 to 7*a*, which illustrate thumb receiving portion 42 in two different positions, a first extended position depicted by FIGS. 4 to 5*a*, and a second bent position depicted by FIGS. 6 to 7*a*. As illustrated in FIGS. 4 and 6, braid 52 encloses outer lip 54 and encircles the entire circumference of thumb shell 44. As previously described, a sewing line 56 in combination with braid 52 secures first and second shell portions 48 and 50 to inner thumb sheath 46 and palm portion 36. A curvilinear overlapping portion 60 is defined by the overlapping of first and second shell portions 48 and 50.

The overlapping portion 60 ensures that for all position of thumb receiving portion 42, no unprotected gaps occur where thumb shell 44 is split into first and second shell portions 48 and 50. Shell portion 48 further comprises a ventilation aperture 58 to provide airflow to the inside portion of protective glove 20.

FIG. 4 illustrates the thumb receiving portion 42 in the extended position. FIGS. 5 and 5*a* are cross sectional views of thumb shell 44 taken at line 5—5 of FIG. 4. FIG. 5*a* illustrates the arrangement of the overlapping portion 60 and also shows the outer lip 54 which extends from shell portion 50. FIG. 5*a* is an enlarged view of the overlapping portion 60. Shell portion 50 includes an overhang portion 62, which extends above an underhanging portion 64 of shell portion 48. A locking lip 66 extends downwardly from the extremity of overhang portion 62 and similarly, a second locking lip 68 extends upwardly from the extremity of underhanging portion 64. Locking lip 66 is designed to abut against a wall 70, which defines the inner limit of underhanging portion 64 so that in operation, if thumb receiving portion 42 is forced to bend backward, the abutment of lip 66 onto wall 70 will prevent hyperextension of the thumb. Second locking lip 68 complements this backward motion limiting task by itself abutting against an inner wall 72 defined by overhang portion 62.

FIG. 6 illustrates the thumb receiving portion 42 in the bent position. As best shown in FIGS. 7 and 7*a*, locking lip 66 is also designed to abut against second locking lip 68 of underhanging portion 64 to limit the range of motion or bending of shell portion 50 relative to shell portion 48 so that thumb receiving portion 42 will not overbend, cause discomfort to the wearer and also open an unprotected gap between shell portions 48 and 50.

Each locking lip 66 and 68 extends along a segment of the length of overlapping portion 60. It is not essential that locking lips 66 and 68 extend the full length of overlapping portion 60 but they must face each other so as to interact together when the thumb receiving portion 42 is bent as depicted in FIGS. 6 to 7*a*.

The hinge mechanism and the locking mechanism provide an articulation of thumb receiving portion 42 which is located between the distal phalanx and the middle phalanx of the thumb thereby allowing flexion of second shell portion 50 with relation to first shell portion 48 while preventing hyperextension and overbending of the wearer's thumb. Thumb receiving portion 42 has the advantage of accommodating the natural position of the hand that is holding a hockey stick or any other sport implement and accommodating the natural movement of the thumb when handling a hockey stick or other sport implement. The provision of a hinged thumb receiving portion has the advantage of allowing the thumb to bend inwardly in an unrestricted manner. As previously described, thumb receiving portion 42 further protects against hyperextension and overbending of the wearer's thumb.

Hinge mechanisms, other than connecting second shell portion 50 to first shell portion 48 with braid 52, are possible without departing from the invention. For instance, shell portions 48 and 50 could be tied together at their bases. Shell portions 48 and 50 could also be joined together at their bases using fasteners such as rivets which would allow rotational movement of shell portion 50 relative to shell portion 48.

In the embodiment disclosed herein, shell portions 48 and 50 are made of a rigid plastic having a thickness sufficient to protect the player's thumb against injuries resulting from direct blows. The plastic material of thumb shell portions 48 and 50 is uncovered and exposed and as such is an integral part of the general appearance of the protective glove 20. To this purposes, the designer may choose almost any color of plastic material which best suits his need to create an attractive protective sporting glove 20. The thumb receiving portion of a prior art protective gloves is usually covered with a layer of material which is reinforced with one or more rigid plastic inserts adapted to protect the wearer's thumb against impacts. In the present design, the rigid shell portions 48 and 50 make up the outer layer of thumb receiving portion 42 and as such are an important esthetic feature of protective glove 20.

Referring now to FIGS. 8 to 11, the connection of cuff portion 24 with hand receiving portion 22 at the wrist area is protected by a heavy padding bracelet 82 enveloping a substantial portion of the circumference of the wrist. The dorsal side 28 of hand receiving portion 22 is heavily padded and further comprises air pockets 84. Air pockets 84 are adapted to absorb an impact yet at the same time slightly decrease the overall weight of protective glove 20. In the illustrated example, a pair of air pockets 84 is provided in the central portion of the dorsal side 28. However a plurality of such air pockets could be used to further decrease the glove's weight while maintaining adequate impact protection.

Figure 8:
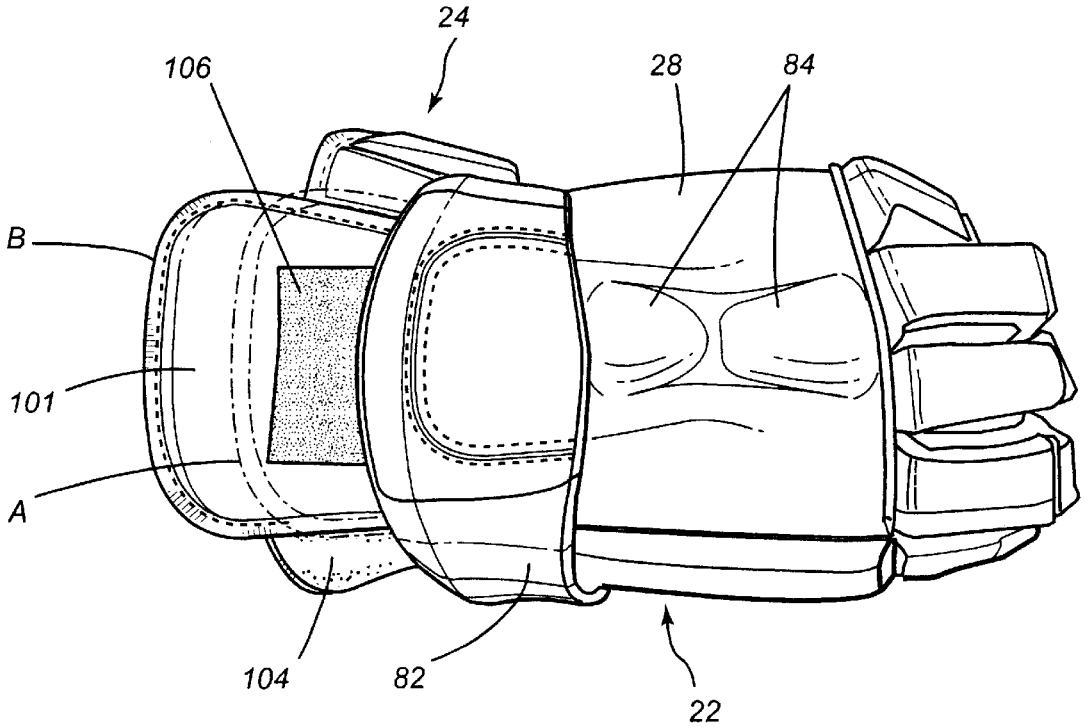
FIG. 8 is a top plan view of the protective sporting glove shown in FIG. 1 showing an adjustable padded element of the cuff portion in the fully extended position according to one embodiment of the invention.
Figure 9:
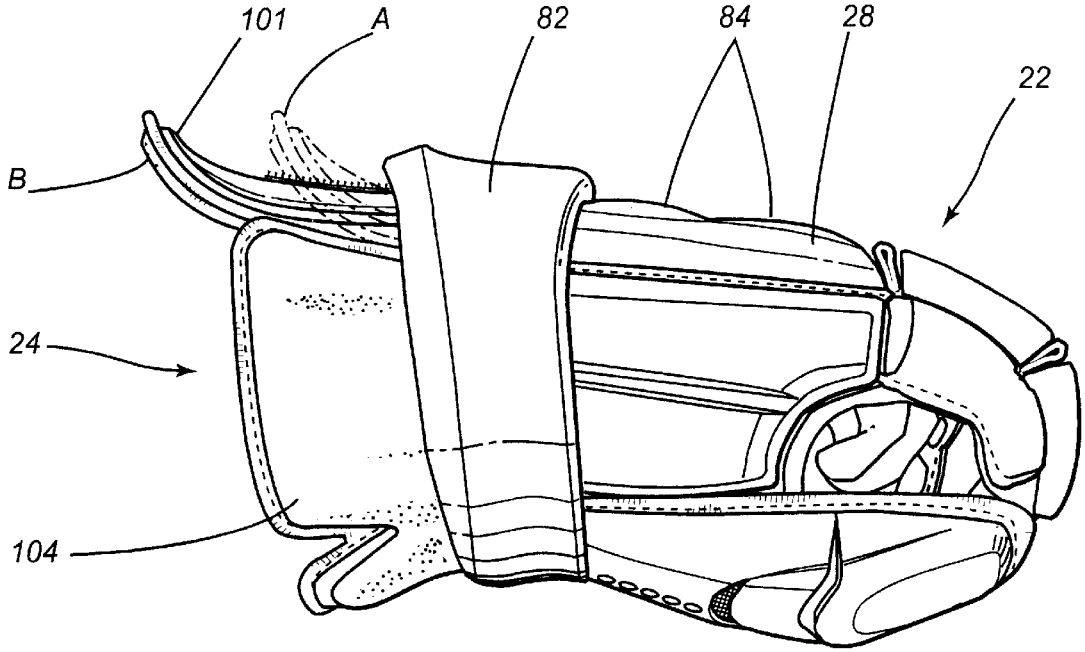
FIG. 9 is a side elevational view of the protective sporting glove shown in FIG. 8 showing the adjustable padded element of the cuff portion in the fully closed position according to one embodiment of the invention.

Cuff portion 24 comprises an array of padding elements sewn or otherwise attached to hand receiving portion 22 underneath padding bracelet 82. In the illustrated example, a series of four padding elements 101, 102, 103 and 104 (FIGS. 10 and 11) are provided. Each padding element is independent from the next and is able to flex inwardly or outwardly as necessary. Padding element 101, which covers the outer face of the lower arm, is further adapted to be adjustable in length. Padding element 101 is also connected to hand receiving portion 22 but an intermediate textile material is sewn between padding element 101 and hand receiving portion 22 such that a minimum length "A" (shown in stippled lines) as well as a maximum length "B" (full lines) can be reached. A hooks and loops fastener is provided between padding element 101 and padding bracelet 82 to secure padding element 101 in the desired position which can be any position between maximum length "B" and minimum length "A" as shown in FIGS. 8 and 9. A hooks section 106 is located on the outer surface of padding element 101 while a loops section is located on the inner surface of padding bracelet 82. In use, the player disengages the hooks and loops fastener, positions padding element 101 in the desired location and re-engages the hooks and loops fastener.

Figure 10:
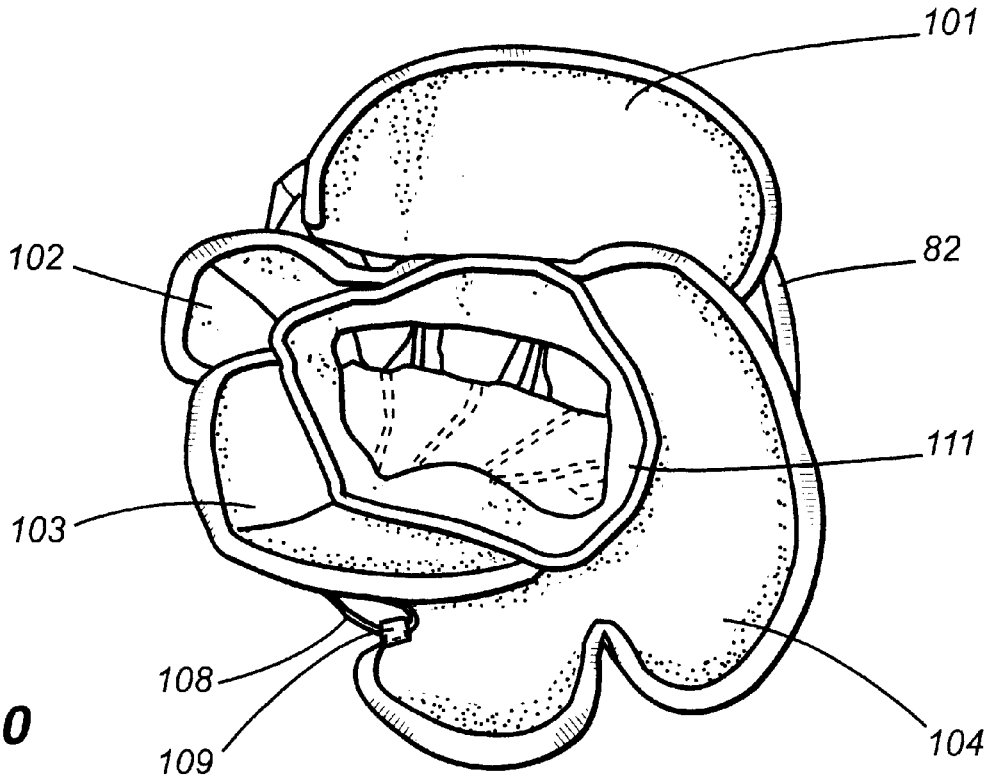
FIG. 10 is a rear view of the protective sporting glove shown in FIG. 1, the array of padding elements of the cuff portion being shown in the large setting position.
Figure 11:
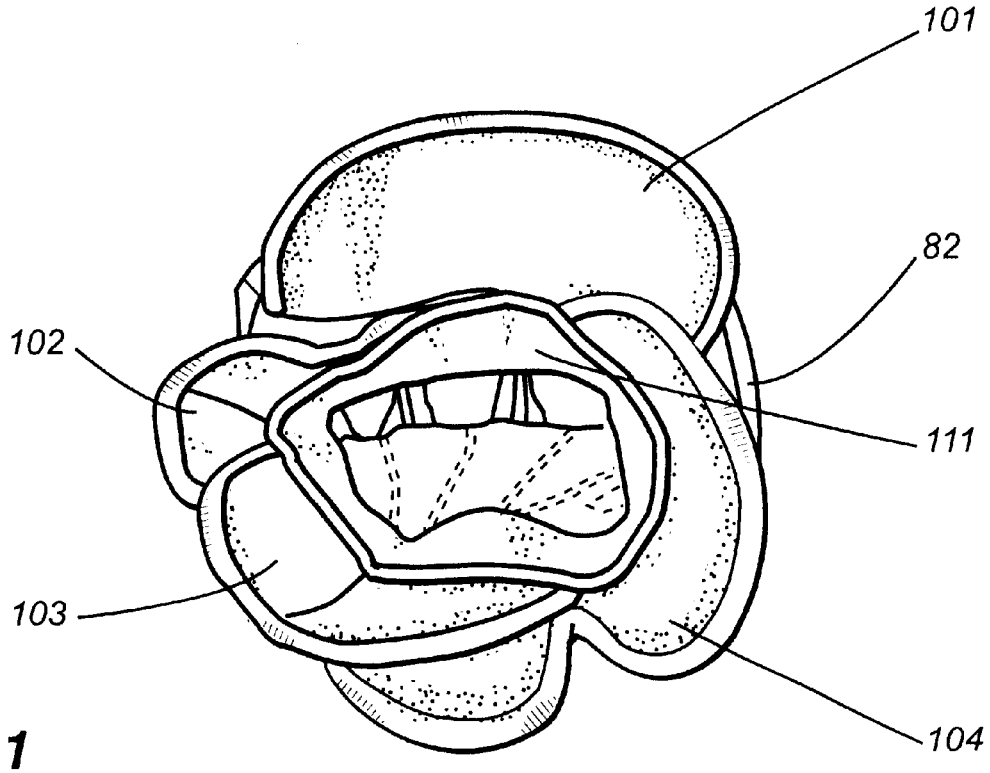
FIG. 11 is a rear view of the protective sporting glove shown in FIG. 1, the array of padding elements of the cuff portion being shown in the small setting position.
Figure 12A:
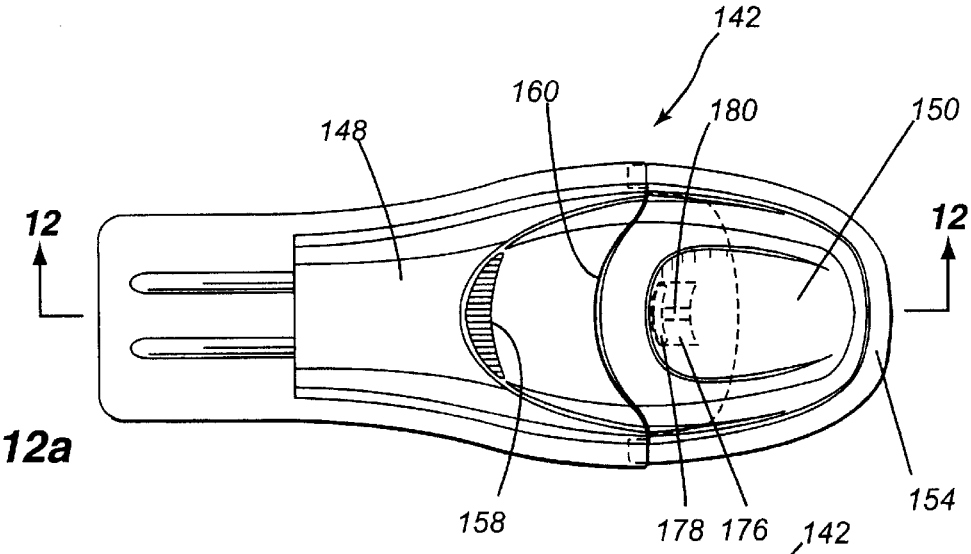
FIG. 12*a* is an enlarged plan view of a thumb receiving portion constructed according to a second embodiment of the invention, the thumb receiving portion being shown in the extended position.
Figure 12B:
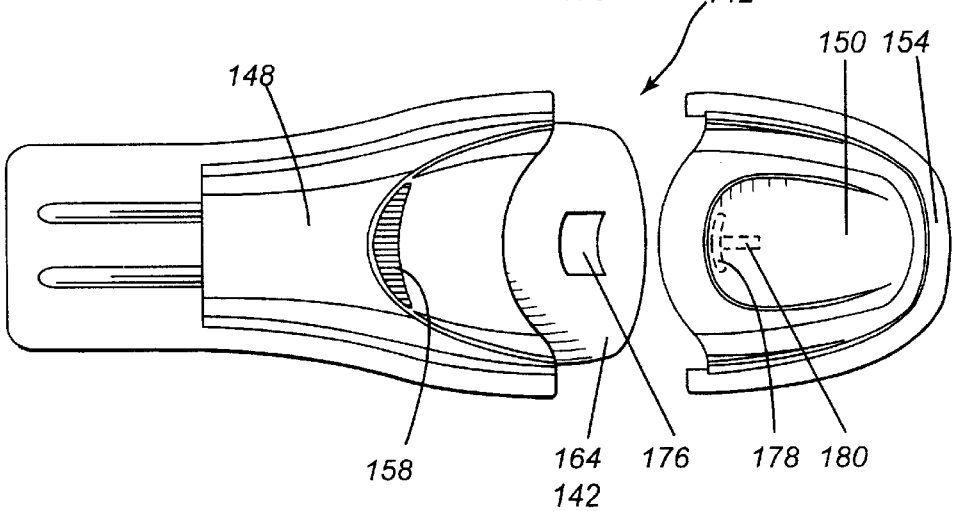
FIG. 12*b* is an enlarged plan view of the thumb receiving portion depicted in FIG. 12*a*, the thumb receiving portion being disassembled to more clearly show the interrelation of its components.

Referring back to FIG. 3, cuff portion 24 further comprises an adjustment means of the diameter defined by padding elements 101, 102, 103 and 104. In the illustrated example, a strap 108 is sewn at one extremity to padding element 102, inserted into a ring 109 attached to padding element 102, folded back onto itself and secured by a hooks and loops fastener (not shown) provided in the overlapping portion of strap 108. FIG. 10 shows the general outline of padding elements 101, 102, 103 and 104 when in the large setting position. As can be seen, the padding elements loosely encircle the forearm and defining a peripheral forearm protector. In this setting, strap 108 is loosely tightened around the player's wrist. FIG. 11, alternatively, shows padding elements 101, 102, 103 and 104 when in the small setting position, much more tightly packed together and therefore closer to the player's forearm. Both settings provide adequate protection and it is a matter of preference for the player to choose his or her favorite setting. The advantage of such an adjustable padding element is the ability to provide a custom fit of cuff portion 24 with a variety of elbow pads positioned adjacent protective glove 20.

Cuff portion 24 also comprises an inner band 111 made of an absorbing textile material which surrounds the wearer's wrist and prevents humidity or perspiration from the forearm from slipping onto the hand receiving portion. Inner band 111 also partially isolates the hand from cold temperature.

FIGS. 12*a* to 13*b* depict a second embodiment of a thumb receiving portion, designated by the reference numeral 142, prior to its coupling with a protective sporting glove. Thumb receiving portion 142 also comprises two rigid shell portions, namely: first rigid shell portion 148 and second rigid shell portion 150. Shell portion 148 comprises a ventilation aperture 158 to provide airflow to the inside portion of protective glove 20. A curvilinear overlapping portion 160 is defined by the overlapping of first and second shell portions 148 and 150. Both shell portions are made of a rigid material such as high impact nylon and the like, capable of impact resistance at very low temperature and capable of providing suitable protection to this sensitive area that is susceptible of receiving numerous blows during the course of a game or practice. As shown, thumb receiving portion 142 also includes an outer lip 154 such as that described in connection with the previous embodiment. When thumb receiving portion 142 is coupled to a protective sporting glove, a textile braid is typically sewn to each shell portion 148, 150 via outer lip 154 in such a manner that both rigid portions are hinged together.

Figure 13A:
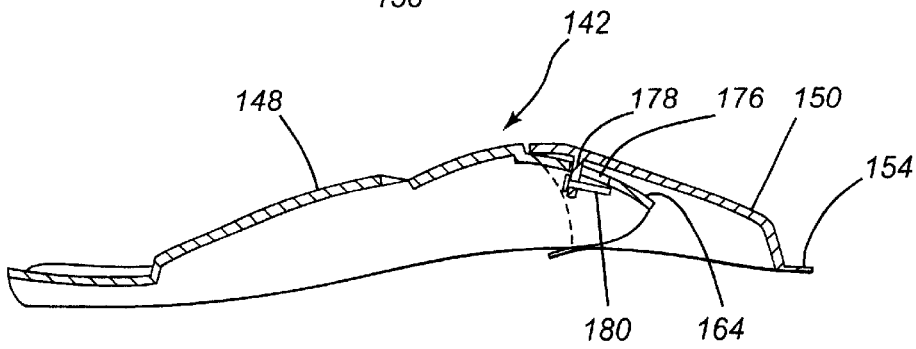
FIG. 13*a* is a cross sectional view of the thumb receiving portion taken at lines 12—12 of FIG. 12*a*, the thumb receiving portion being shown in the extended position.
Figure 13B:
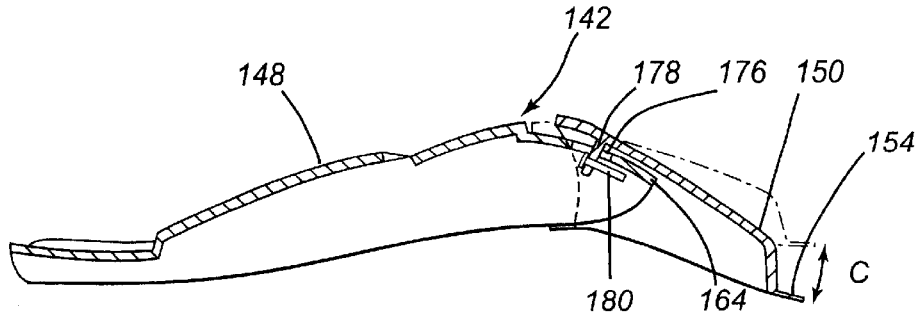
FIG. 13*b* is a cross sectional view of the thumb receiving portion taken at lines 12—12 of FIG. 12*a*, the thumb receiving portion being shown in the bent position.
Figure 14A:
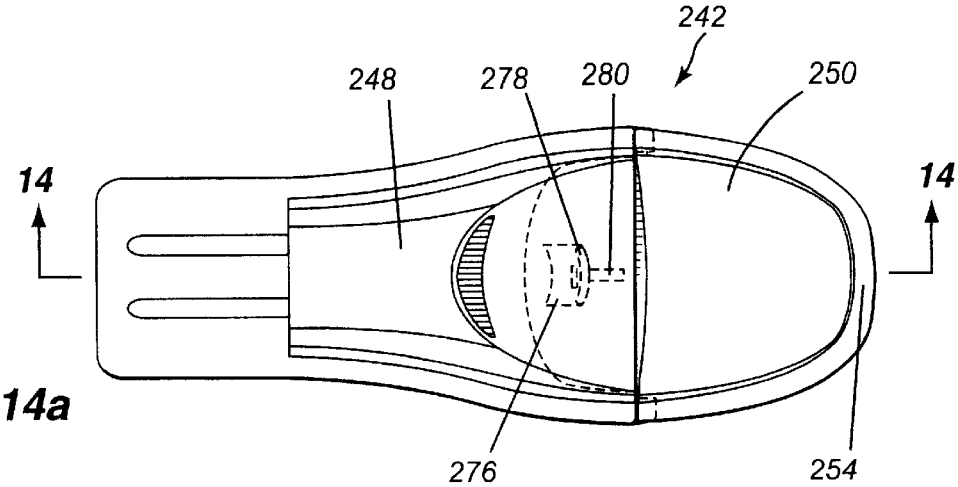
FIG. 14*a* is an enlarged plan view of a thumb receiving portion constructed according to a third embodiment of the invention, the thumb receiving portion being shown in the extended position.
Figure 14B:
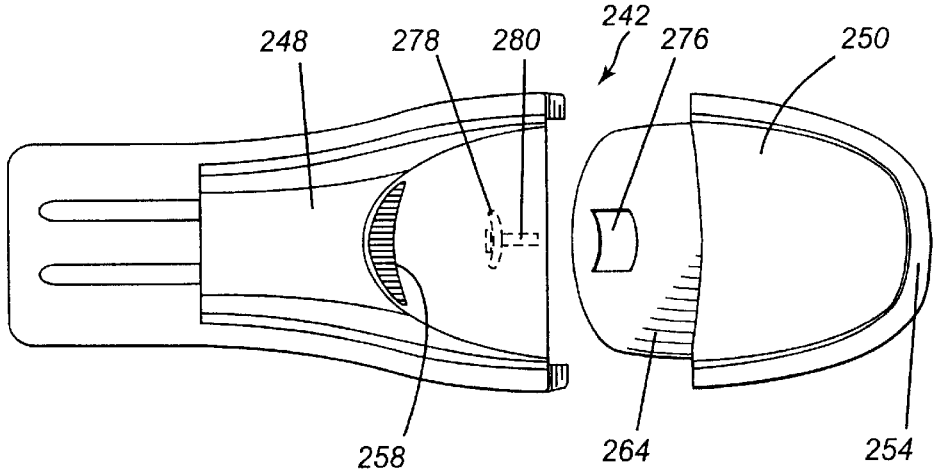
FIG. 14*b* is an enlarged plan view of the thumb receiving portion depicted in FIG. 14*a*, the thumb receiving portion being disassembled to more clearly show the interrelation of its components.

In the embodiment illustrated in FIGS. 12*a* to 13*b*, however, the mechanism which ensures the locking of both shell portions with respect to one another is slightly different. As shown, first rigid shell portion is provided with an underhanging portion 164 that extends forwardly and which is adapted to underlie the second rigid shell portion 150. Near the center of underhanging portion 164 is a slot 176 of oblong shape; the purpose of which will be described subsequently. As shown in FIGS. 13*a* and 13*b*, the second rigid shell portion features a projection 178 in the form of curvilinear arc on its underside. The latter component is shown in stippled lines in FIGS. 12*a* and 12*b*. Projection 178 is situated in a slightly receded fashion with respect to the exterior edge (i.e., the one which engages first rigid shell portion 148) of second rigid shell portion 150. In fact, projection 178 is positioned and dimensioned in such a manner as to be capable of insertion into slot 176. During the fabrication stage, once projection 178 is inserted into slot 176, a screw-like member 180 is inserted within projection 178 and extends laterally therefrom. More specifically, screw-like member 180 is of a length that is slightly superior to that of slot 176. As a result, once both rigid shell portions 148, 150 are coupled via the locking mechanism described above, they are inseparable. FIG. 13*a* and 13*b* show the relative positioning of first and second rigid shell portions 148, 150 when the wearer of the protective sporting glove incorporating thumb receiving portion 142 flexes his or her thumb. As illustrated, thumb receiving portion 142 is capable of moving between an extended position (FIG. 13*a*) and a bent position (FIG. 13*b*) defined by the arc C in FIG. 13*b*. It is important to note that when thumb receiving portion 142 is in a bent position, the underhanging portion 164 of the first rigid shell portion 148 covers the gap created by the flexing action and thereby ensures that level of protection offered is not compromised. Similarly, FIGS. 13*a* and 13*b* also show that the longitudinal length of slot 176 ensures that projection 178 can move back and forth therein when the user flexes his or her thumb. Projection 178 is therefore at its most forward position with respect to first rigid shell portion 148, and thus slot 176, when thumb receiving portion 142 is in its bent position.

FIGS. 14*a* to 15*b*, which depict a thumb receiving portion 242 according to yet another embodiment, show a variant of the previous embodiment. Thumb receiving portion 242 also comprises two rigid shell portions, namely: first rigid shell portion 248 and second rigid shell portion 250. Shell portion 248 comprises a ventilation aperture 258 to provide airflow to the inside portion of protective glove 20. In this variant, underhanging portion 264 is integral with second rigid shell portion and projects rearwardly therefrom. Underhanging portion 264, more precisely, is adapted to engage the underside of the first rigid shell portion 248. As shown, thumb receiving portion 242 also includes an outer lip 254 such as that described in connection with the previous embodiments. It should also be noted that slot 276, in this embodiment, is consequently positioned near the center of underhanging portion 264 while projection 278 is associated with the first rigid shell portion 248. Once projection 278 is inserted within slot 276 during the manufacture of the protective sporting glove, a screw-like member 280 is also provided to ensure their fixed connection.

Figure 15A:
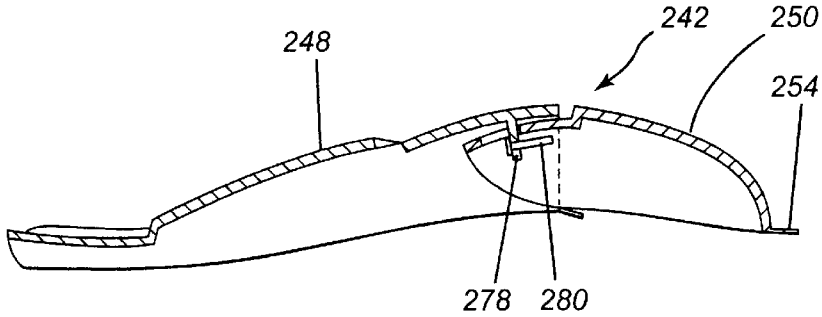
FIG. 15*a* is a cross sectional view of the thumb receiving portion taken at lines 14—14 of FIG. 14*a*, the thumb receiving portion being shown in the extended position.
Figure 15B:
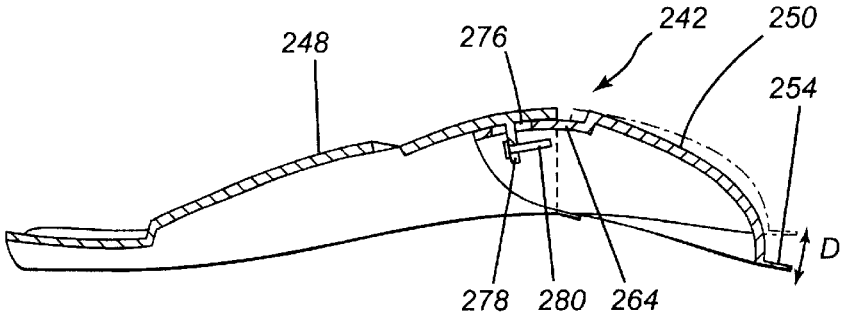
FIG. 15*b* is a cross sectional view of the thumb receiving portion taken at lines 14—14 of FIG. 14*a*, the thumb receiving portion being shown in the bent position.

FIGS. 15*a* and 15*b*, more specifically, respectively show thumb receiving portion 242 in an extended and bent manner. As shown, thumb receiving portion 242, when reciprocating back and forth between these two positions, defines arc D. As in the previous embodiment, the range of pivotal motion of thumb receiving portion 242 is determined by the length of slot 276.

In each embodiments of the invention the thumb receiving portion is shown uncovered. However as a refinement of the design, the first shell portions 48, 148 and 248 may be covered with a layer of padding such that the first shell portions blend in with the hand receiving portion of the protective gloves.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A hockey glove for enclosing a human wrist and hand, the hand including a dorsal side, a palm side, four fingers and one thumb having a dorsal side, an inner side, a middle phalanx, a distal phalanx and an articulation between the middle and distal phalanxes, said hockey glove including a hand-receiving portion comprising:

(a) a palm side facing the palm side of the hand;

(b) a dorsal side facing the dorsal side of the band, said dorsal side of said hand-receiving portion having a padded surface;

(c) finger sheaths receiving the four fingers of the band; an (d) a thumb-receiving portion receiving the thumb of the band, said thumb-receiving portion having a rigid thumb shell coveting at least in part the dorsal side of the thumb, said rigid thumb shell having first and second shell portions that partially overlap one another, said first shell portion covering at least partially the middle phalanx of the thumb, said second shell portion covering at least partially the distal phalanx of the thumb, said first shell portion being hinged to said second shell portion.

2. The hockey glove as defined in claim 1 wherein said first and second shell portions are hinged together near the articulation between the middle and distal phalanxes.

3. The hockey glove as defined in claim 1 wherein said thumb-receiving portion further comprises an inner side facing the inner side of the thumb, each of said first and second shell portions comprises an outer lip extending along its outer edge, said outer lip being sewn to said inner side of said thumb-receiving portion.

4. The hockey glove as defined in claim 1 wherein said first and second shell portions comprise stopping means for preventing movement of said second shell portion beyond a predetermined point.

5. The hockey glove as defined in claim 1 wherein a degree of overlap between said first and second shell portions varies when one of said first and second shell portions is hingedly moved relative to the other of said first and second shell portions.

6. The hockey glove as defined in claim 5 wherein said first shell portion partially extends underneath said second shell portion.

7. The hockey glove as defined in claim 6 wherein each of said first and second shell portions comprises an internal locking lip along its respective overlapping portion, said internal locking lips engaging each other at a predetermined point when said second shell portion is fully bent.

8. The hockey glove as defined in claim 7 wherein said first shell portion comprises an abutting portion adapted to engage said internal locking lip of said second shell portion for preventing hyperextension of the thumb.

9. The hockey glove as defined in claim 1 wherein said rigid thumb shell further comprises a ventilation aperture.

10. The hockey glove as defined in claim 1 wherein said padded surface located on the dorsal side of said hand-receiving portion comprises an air pocket for absorbing impacts.

11. The hockey glove as defined in claim 1 further comprising a cuff portion surrounding the wrist, said cuff portion having a plurality of padded elements positioned around at least a portion of the circumference of said cuff portion and defining a peripheral forearm protector, each said padded element partially overlapping an adjacent padded element.

12. The hockey glove as defined in claim 11 wherein the diameter of said cuff portion is adjustable.

13. The hockey glove as defined in claim 12 wherein one of said padded elements is adjustable in length.

14. A hockey glove for enclosing a human wrist and hand, the hand including a dorsal side, a palm side, four fingers and one thumb having a dorsal side, an inner side, a middle phalanx, a distal phalanx and an articulation between the middle and distal phalanxes, said hockey glove comprising:

(a) a cuff portion surrounding the wrist;

(b) a hand-receiving portion having a thumb-receiving portion receiving the thumb of the hand, said thumb-receiving portion having a rigid thumb shell covering at least in part the dorsal side of the thumb, said rigid thumb shell having first and second shell portions that partially overlap one another;

(c) a tint movable joint between said cuff portion and said first shell portion; and (d) a second movable joint between said first and second shell portions.

15. The hockey glove as defined in claim 14 wherein said first and second shell portions are hinged together near the articulation between the middle and distal phalanxes.

16. The hockey glove as defined in claim 14 wherein said thumb-receiving portion further comprises an inner side facing the inner side of the thumb, each of said first and second shell portions comprises an outer lip extending along its outer edge, said outer lip being sewn to said inner side of said thumb-receiving portion.

17. The hockey glove as defined in claim 14 wherein said first and second shell portions comprise stopping means for preventing movement of said second shell portion beyond a predetermined point.

18. The hockey glove as defined in claim 14 wherein a degree of overlap between said first and second shell portions varies when one of said first and second shell portions is hingedly moved relative to the other of said first and second shell portions.

19. The hockey glove as defined in claim 18 wherein said first shell portion partially extends underneath said second shell portion.

20. The hockey glove as defined in claim 19 wherein each of said first and second shell portions comprises an internal locking lip along its respective overlapping portion, said internal locking lips engaging each other at a predetermined point when said second shell portion is fully bent.

21. The hockey glove as defined in claim 20 wherein said first shell portion comprises an abutting portion adapted to engage said second shell portion for preventing hyperextension of the thumb.

22. The hockey glove as defined in claim 14 wherein said rigid thumb shell further comprises a ventilation aperture.

23. The hockey glove as defined in claim 14 wherein said cuff portion comprises a plurality of padded elements positioned around at least a portion of the circumference of said cuff portion and defining a peripheral forearm protector, each said padded element partially overlapping an adjacent padded element.

24. The hockey glove as defined in claim 23 wherein the diameter of said cuff portion is adjustable.

25. The hockey glove as defined in claim 23 wherein one of said padded elements is adjustable in length.

* * * * *

UNITED STATES PATENT AND TRADEMARK OFFICE

CERTIFICATE OF CORRECTION

PATENT NO. : 6,543,057 B2 
DATED : April 8, 2003
INVENTOR(S) : Jean-Francois Béland and Jean-Francois Fullum It is certified that error appears in the above-identified patent and that said Letters Patent is hereby corrected as shown below:

Column 10,
Line 41, delete "tint" and insert -- first --.

Signed and Sealed this

Second Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,543,057 B2 
DATED : April 8, 2003
INVENTOR(S) : Jean-Francois Béland and Jean-Francois Fullum It is certified that error appears in the above-identified patent and that said Letters Patent is hereby corrected as shown below:

Column 9,
Line 42, delete "'''coveting" and insert -- covering --.

Signed and Sealed this

Twenty-ninth Day of June, 2004

JON W. DUDAS
*Acting Director of the United States Patent and Trademark Office*